US009393605B2

(12) United States Patent
Hayashi

(10) Patent No.: US 9,393,605 B2
(45) Date of Patent: Jul. 19, 2016

(54) UPPER TOOL HOLDER FOR PRESS BRAKE

(75) Inventor: Shiro Hayashi, Kanagawa (JP)

(73) Assignee: AMADA COMPANY, LIMITED, Kanagawa (JP)

( * ) Notice: Subject to any disclaimer, the term of this patent is extended or adjusted under 35 U.S.C. 154(b) by 425 days.

(21) Appl. No.: 13/824,592

(22) PCT Filed: Oct. 14, 2011

(86) PCT No.: PCT/JP2011/073693

§ 371 (c)(1),
(2), (4) Date: Mar. 18, 2013

(87) PCT Pub. No.: WO2012/053450

PCT Pub. Date: Apr. 26, 2012

(65) Prior Publication Data

US 2013/0180311 A1 Jul. 18, 2013

(30) Foreign Application Priority Data

Oct. 19, 2010 (JP) ..... 2010-234443

(51) Int. Cl.
*B21D 5/02* (2006.01)

(52) U.S. Cl.
CPC ..... *B21D 5/0236* (2013.01)

(58) Field of Classification Search
CPC ..... B21D 5/02; B21D 5/0209; B21D 5/0236; B21D 37/04; B21D 37/14
See application file for complete search history.

(56) References Cited

U.S. PATENT DOCUMENTS

| | | | | |
|---|---|---|---|---|
| 5,513,514 | A * | 5/1996 | Kawano | 72/482.91 |
| 5,794,486 | A * | 8/1998 | Sugimoto et al. | 72/481.3 |
| 6,446,485 | B1 | 9/2002 | Tarasconi | |

FOREIGN PATENT DOCUMENTS

| | | |
|---|---|---|
| JP | 8-57542 | 3/1996 |
| JP | 11-090535 | 4/1999 |
| JP | 2002-540946 | 12/2002 |
| JP | 2003-340522 | 12/2003 |
| WO | 00/59654 | 10/2000 |

OTHER PUBLICATIONS

International Search Report dated Dec. 6, 2011 with English language translation thereof.

* cited by examiner

*Primary Examiner* — Teresa M Ekiert
(74) *Attorney, Agent, or Firm* — Greenblum & Bernstein, P.L.C.

(57) ABSTRACT

A upper tool holder for a press brake includes a holder body; an upper tool clamper provided on the holder body and capable of swinging when replacing the upper tool; an auxiliary urging mechanism that functions as resistance when opening the upper tool clamper further in order to replace the upper tool, and functions so as to support a closing operation when closing the upper tool clamper from a further opened state; and a pusher provided in the auxiliary urging mechanism and urged in a closing direction of the upper tool clamper. According to the upper tool holder, unexpected drop-off of the upper tool can be prevented, so that safety can be improved.

3 Claims, 9 Drawing Sheets

-- PRIOR ART --

-- PRIOR ART --

-- PRIOR ART --

-- PRIOR ART --

-- PRIOR ART --

-- PRIOR ART --

UPPER TOOL HOLDER FOR PRESS BRAKE

TECHNICAL FIELD

The present invention relates to an upper tool holder for holding an upper tool of a press brake detachably, especially to a highly secure upper tool holder by which it does not occur that an upper tool clamper for clamping an upper tool opens unexpectedly and thereby the upper tool drops off.

BACKGROUND ART

A prior-art press brake (for example, see Patent Document 1) includes plural upper tool holders 121 as shown in FIG. 7 to FIG. 12 at a lower portion of an upper table to which upper tools are attached in order to replace the upper tools easily.

An upper tool clamper 127 for clamping an upper tool 125 is swingably provided on a holder body 123 of the upper tool holder 121. Then, a drop prevention piece 129 to be engaged with a drop prevention groove 125G of the upper tool 125 is attached to a lower portion of the upper tool clamper 127.

A lower potion of the holder body 123 is formed as an upper tool holding portion 131. The upper tool clamper 127 and the upper tool holding portion 131 clamp and unclamp the upper tool 125. A pusher screw 133 is threaded onto an upper portion of the upper tool clamper 127. An end of the pusher screw 133 is contacted with a pusher 135 that is urged outward by urging elements embedded in the holder body 123. An operating lever 137 is attached to the pusher screw 133 in order to operate rotation of the pusher screw 133.

Stoppers 139A and 139B for restricting the rotation of the operating lever 137 is disposed on a front face of the holder body 123. Each of the stoppers 139A and 139B is set on a rotational path of the operating lever 137 (rotation is restricted), or moved out of the rotational path (rotation is allowed). In addition, urging members 141 for continuously urging the upper tool clamper 127 slightly toward its closing direction are disposed between the holder body 123 and the upper tool clamper 127. Further, a ball plunger 145 to be engaged with an engagement recess 143 formed an upper edge of the upper tool clamper 127 is provided.

According to the above-explained upper tool holder 121, in a state where the operating lever 137 is contacted with the stopper 139A as shown in FIG. 7 and FIG. 8, the upper tool 125 is stiffly pushed onto the upper tool holding portion 131 by the upper tool clamper 127, so that the upper tool 125 is clamped. At this state, the drop prevention groove 125G and the drop prevention piece 129 are engaged with each other. On the other hand, in a state where the operating lever 137 is contacted with the stopper 139B as shown in FIG. 9 and FIG. 10, the upper tool 125 is unclamped. In this state, the drop prevention groove 125G is engaged with an engagement protrusion 127P, so that the upper tool 125 is prevented from dropping off. In addition, the upper tool 125 can slides laterally (along a longitudinal direction of the upper tool 125).

The lower portion of the upper tool clamper 127 can be widely opened by swinging the upper tool 125 in a direction R after rotating the operating lever 137 to pass it over the stopper 139B and then to orient it vertically downward as shown in FIG. 11 and FIG. 12. After opening the upper tool clamper 127, the upper tool 125 can be removed downward. When the lower portion of the upper tool clamper 127 is opened, the engagement recess 143 and the ball plunger 145 are engaged with each other to keep the opened state.

PRIOR ART DOCUMENT

Patent Document

Patent Document 1: Japanese Patent Application Laid-Open No. H8-57542

SUMMARY OF INVENTION

The upper tool 125 can be replaced according to the above-explained upper tool holder 121. In its unclamping state (FIG. 9 and FIG. 10), it is possible to slide the upper tool 125 along its longitudinal direction (laterally) while the upper tool clamper 127 is being urged, by the urging members 141, in a direction for clamping the upper tool 125. However, it may be occurs that the upper tool clamper 127 unexpectedly opens when moving the upper tool 125 and the upper tool 125 drops off, so that improvement is desired.

Here, if urging forces by the urging members 141 are increased in order to prevent the upper tool clamper 127 from opening unexpectedly while moving the upper tool 125, friction for moving the upper tool 125 becomes large and thereby it becomes hard to move it. Note that an inclined surface is formed at an upper portion of the above-explained upper tool 125, so that a minute gap is formed between the upper tool clamper 127 and the upper tool 125 in a state where the upper tool 125 slightly moves downward due to disengagement of the drop prevention groove 125G and the drop prevention piece 129 and the drop prevention groove 125G engages with the engagement protrusion 127P (FIG. 10). It is preferable to urge the upper portion of the upper tool clamper 127 continuously by the urging members 141 in order to prevent such a gap from being formed. However, it may bring in the new problem as explained above to increase pushing forces by the urging members 141.

An aspect of the present invention provides an upper tool holder for a press brake for holding an upper tool of the press brake that includes a holder body; an upper tool clamper that is provided on the holder body, and capable of swinging in an open-close direction when replacing the upper tool; a drop prevention piece that is provided at a lower portion of the upper tool clamper, and capable of engaging with a drop prevention groove formed on the upper tool; an engagement recess that is provided on one of an upper portion of the upper tool clamper and the holder body; an engagement protrustion that is provided on another of the upper portion of the upper tool clamper and the holder body, and capable of engaging with the engagement recess; an auxiliary urging mechanism that functions as resistance when opening the upper tool clamper further in order to replace the upper tool, and functions so as to support a closing operation when closing the upper tool clamper from a further opened state; and a pusher that is provided in the auxiliary urging mechanism, stays at a home position in an ordinary state regardless of an opening or closing operation of the upper tool clamper, and is urged in a closing direction of the upper tool clamper.

According to the above aspect, the auxiliary urging mechanism functions as resistance against the opening operation by contacting the pusher of the auxiliary urging mechanism with the upper tool clamper when opening the upper tool clamper widely in order to replace the upper tool downward from the upper tool holder. Namely, in an unclamping state where fixation of the upper tool is cancelled and the upper tool is held laterally slidably, the resistance applies to the opening operation when the upper tool clamper is opened unexpectedly, so that unexpected opening of the upper tool clamper can be prevented and safety can be improved.

DESCRIPTION OF EMBODIMENTS

Hereinafter, an upper tool holder 1 according to an embodiment will be explained with reference to FIG. 1 to FIG. 6.

Figure 1:
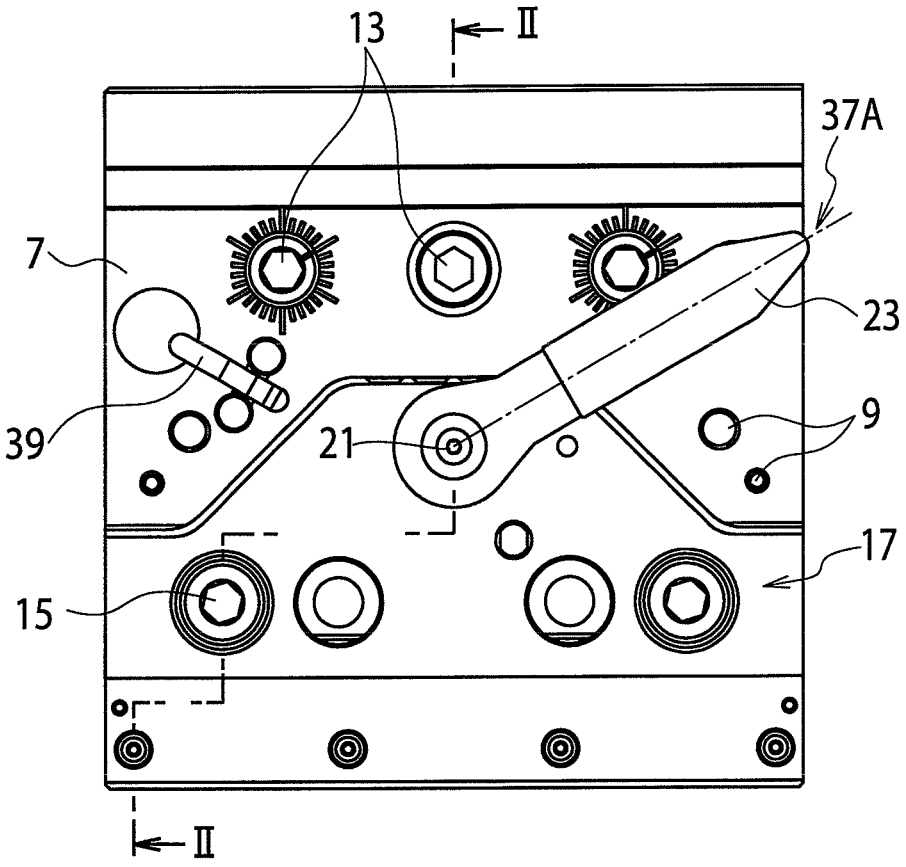
FIG. 1 is a front view of an upper tool holder according to an embodiment (operating lever: clamp position).
Figure 2:
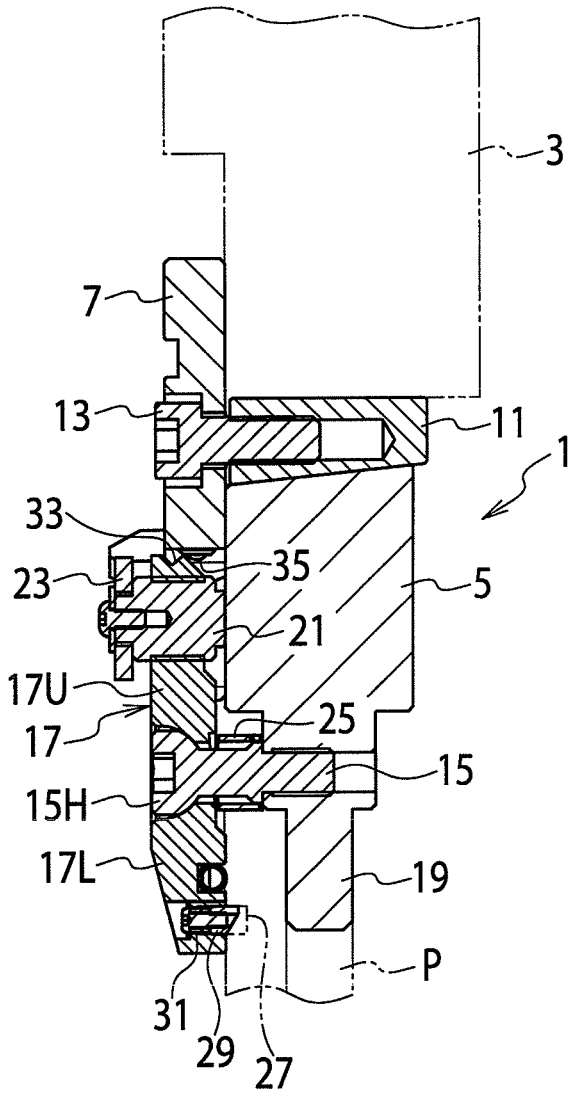
FIG. 2 is a cross sectional view taken along a line II-II shown in FIG. 1.
Figure 3:
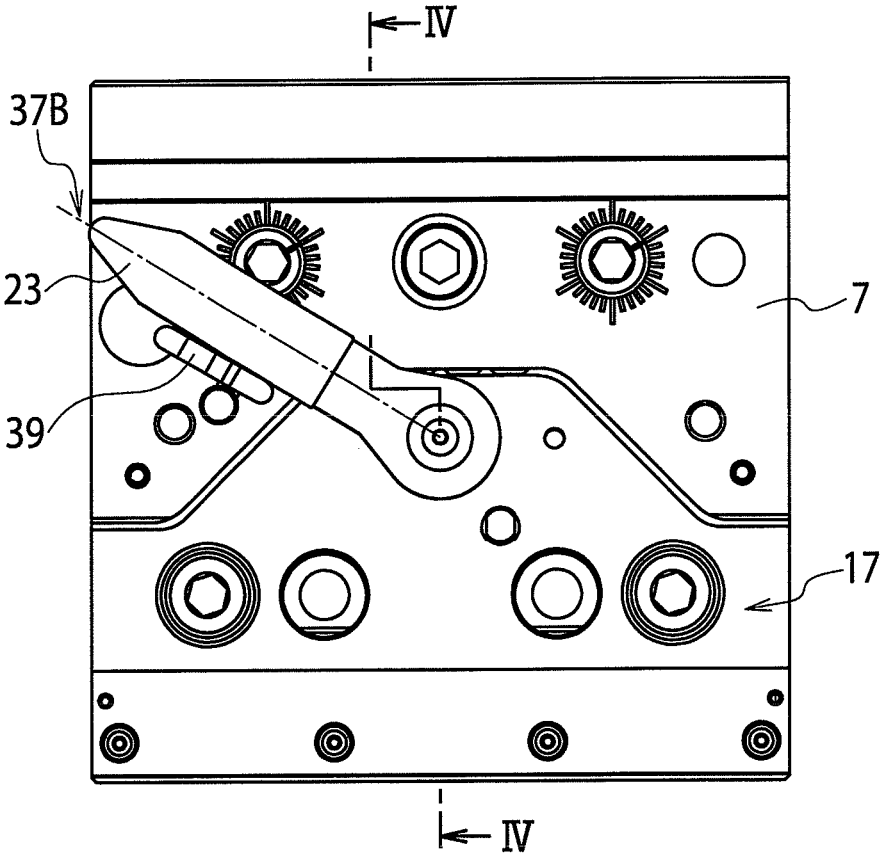
FIG. 3 is a front view of the upper tool holder (operating lever: unclamp position).
Figure 4:
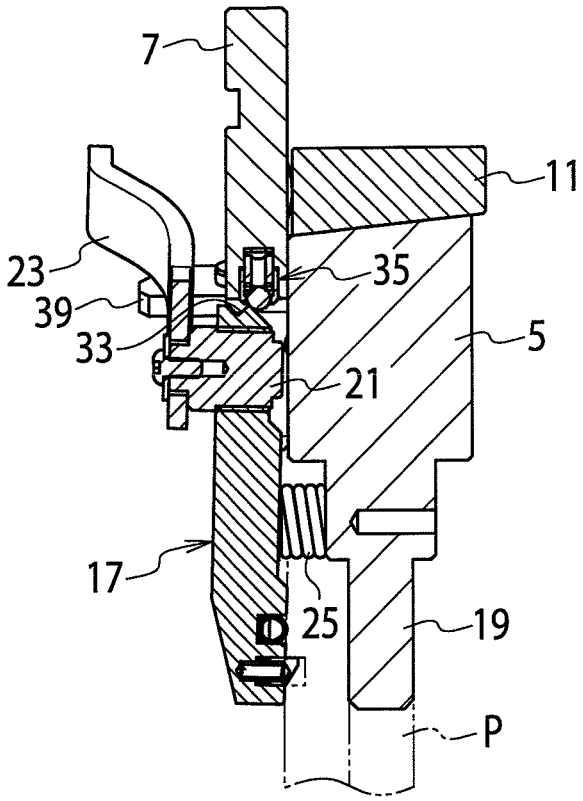
FIG. 4 is a cross sectional view taken along a line IV-IV shown in FIG. 3.
Figure 5:
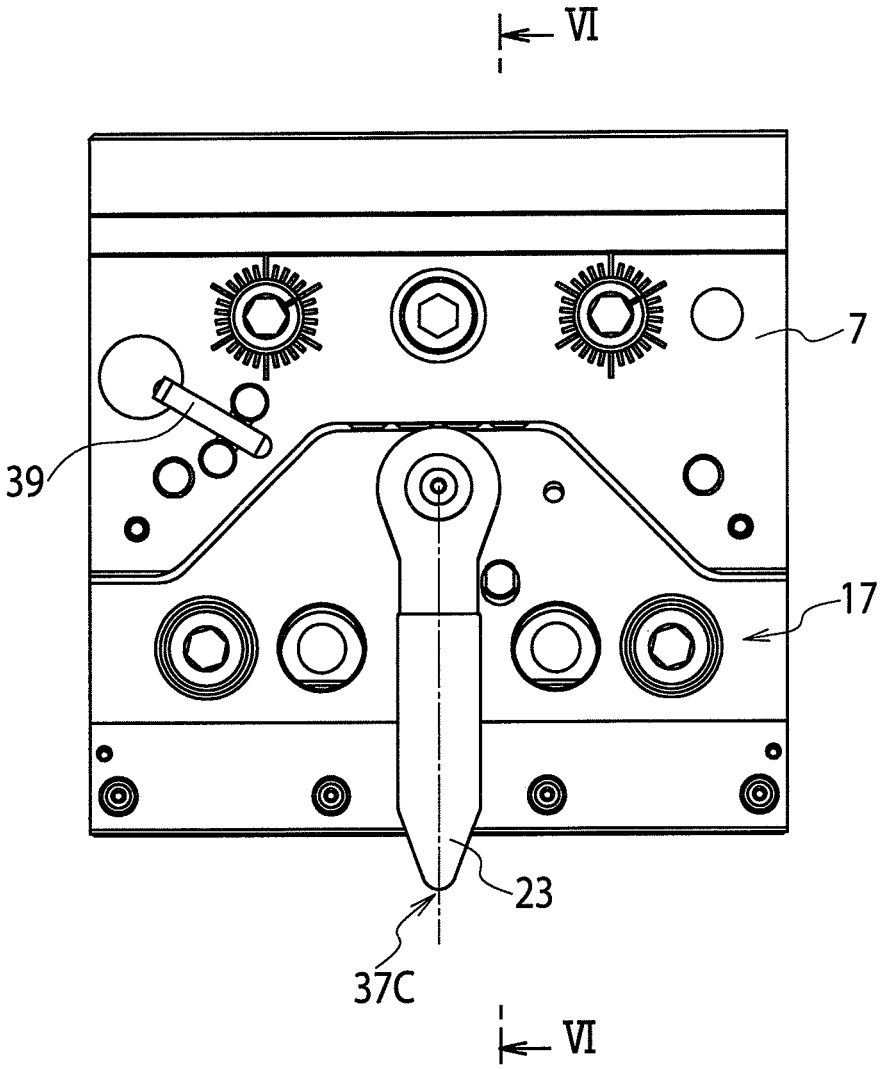
FIG. 5 is a front view of the upper tool holder (operating lever: vertically-replacing position).

As shown in FIG. 1 and FIG. 2 (clamping state), the upper tool holder 1 is attached to a lower portion of a lower table 3 of a press brake. Plural upper tool holders 1 are attached to the lower portion of the lower table 3 laterally (along a lateral direction in FIG. 1, along a direction perpendicular to a paper sheet plane of FIG. 2). Note that attachment of the upper tool holder 1 to the lower table 3 is well known, so its detailed explanation is omitted.

The upper tool holder 1 includes a holder body 5. A mounting plate 7 projected upward is attached to an upper front face of the holder body 5 by fixture pins 9. The mounting plate 7 can be ascribed as a part of the holder body 5. A wedge member 11 is provided on an upper face of the holder body 5 so that its position along front-back direction (a lateral direction in FIG. 2) is adjustable. The mounting plate 7 includes adjustment screws 13, such as push/pull bolts, for adjusting the position of the wedge member 11.

Mounting bolts 15 are horizontally provided on the front face of the holder body 5. An upper tool clamper 17 is hold by heads 15H of the mounting bolts 15 so that it can swing in the front-back direction. An upper tool P is clamped by an upper tool holding portion 19 formed at the lower portion of the holder body 5 and a lower portion 17L of the upper tool clamper 17. In order to adjust clamping of the upper tool P, a pusher screw 21 is threaded onto an upper portion 17U of the upper tool clamper 17 so that it can move along the front-back direction. A rear end of the pusher screw contacts onto the front face of the holder body 5. An operating lever 23 is attached to a front end of the pusher screw 21 in order to operate rotation of the pusher screw 21. Note that coil springs (elastic members) 25 for pushing the upper tool clamper 17 onto the heads 15H are provided between the holder body 5 and the upper tool clamper 17. The mounting bolts 15 are inserted into the coil springs 25, respectively (compressed state in FIG. 2).

A drop prevention piece 29 to be engaged with a drop prevention groove 27 of the upper tool P is attached to a lower portion 17L of the upper tool clamper 17. The drop prevention piece 29 is continuously urged in a projecting direction by coil springs (elastic members) 31. In addition, an engagement recess 33 (such as a groove and a hole) is formed on an upper edge of the upper tool clamper 17. A ball plunger (an engagement protrusion) 35 capable of being engaged with the engagement recess 33 is provided on the mounting plate 7 ascribed as a part of the holder body 5. Note that the drop prevention piece 29, the engagement recess 33 the ball plunger 35 and so on has the same configuration as disclosed in the above-explained Patent Document 1. In addition, since positions of the engagement recess 33 and the ball plunger 35 are relative, it may be possible that the ball plunger 35 is provided on the upper edge of the upper tool clamper 17 and the engagement recess 33 is provided on the mounting plate 7.

The operating lever 23 can be rotated to a clamp position 37A (FIG. 1 and FIG. 2), an unclamp position 37B (FIG. 3 and FIG. 4) and a vertically-replacing position 37C (FIG. 5 and FIG. 6) for removing the upper tool P downward. At the clamp position 37A, the upper tool P is fixed by being pressed onto the upper tool holding portion 19 by the upper tool clamper 17. At the unclamp position 37B, clamping of the upper tool P is released (the upper tool p is slidably held). At the vertically-replacing position 37C, the lower portion 17L of the upper tool clamper 17 is widely opened in order to remove the upper tool P downward. Note that a stopper 39 for restricting rotation of the operating lever 23 to the vertically-replacing position 37C is provided at the unclamp position 37B. Since the stopper 39 has the same configuration as of the prior-art (the stoppers 139A and 139B shown in FIG. 7 to FIG. 12), its detailed explanation is omitted.

According to the above-explained configurations, the operating lever 23 is rotated from the clamp position 37A (clamped state of the upper tool P) to the unclamp position 37B, so that the upper toll P can be moved laterally (along a longitudinal direction of the upper tool P). Further, the operating lever 23 is rotated to the vertically-replacing position 37C, so that the lower portion 17L of the upper tool clamper is widely opened and the upper tool p can be removed downward.

By the way, when the upper tool P is in an unclamped state by rotating the operating lever 23 to the unclamp position, the upper tool P can be replaced by sliding it laterally. At this time, if the lower portion 17L of the upper tool clamper 17 unexpectedly opens further, the upper tool P may drop off.

Figure 6:
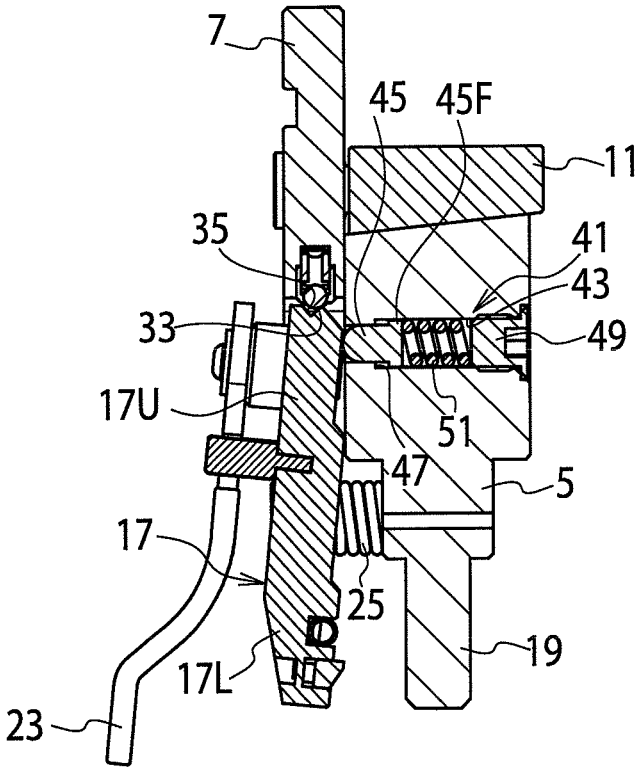
FIG. 6 is a cross sectional view taken along a line VI-VI shown in FIG. 5.
Figure 7:
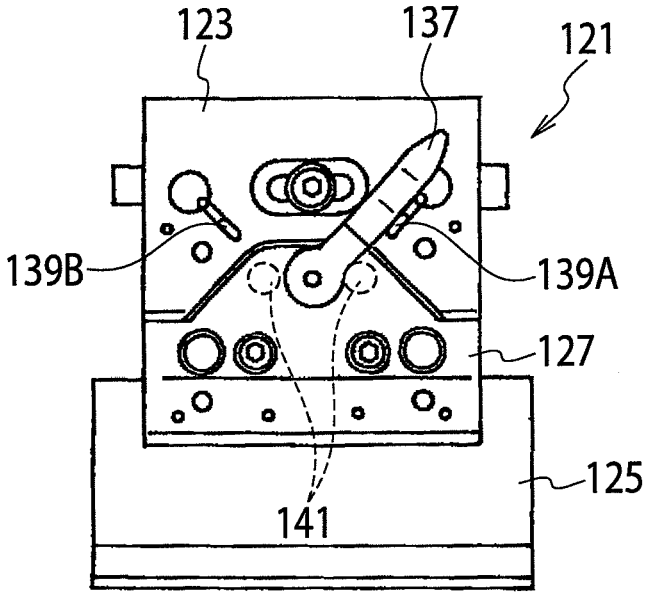
FIG. 7 is a front view of a prior-art upper tool holder (operating lever: clamp position).
Figure 8:
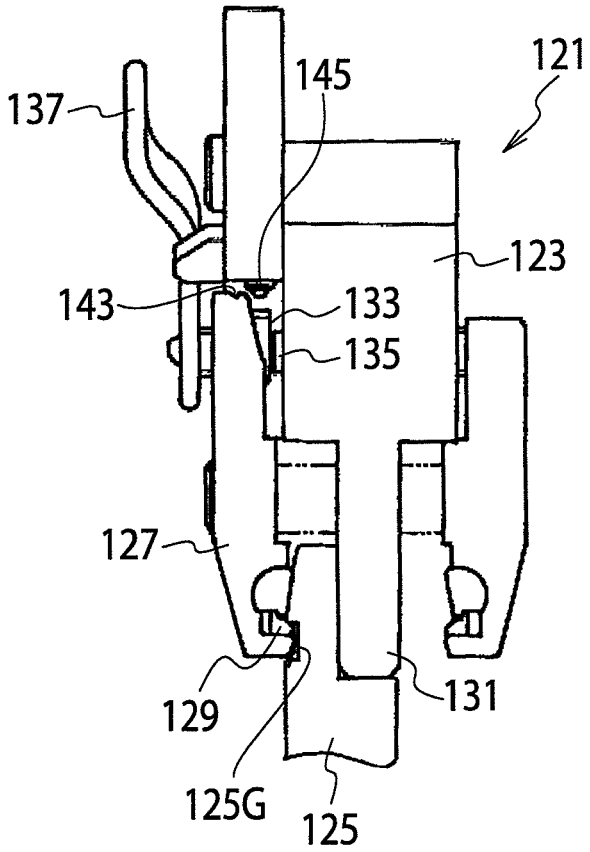
FIG. 8 is a side view of the prior-art upper tool holder shown in FIG. 7.
Figure 9:
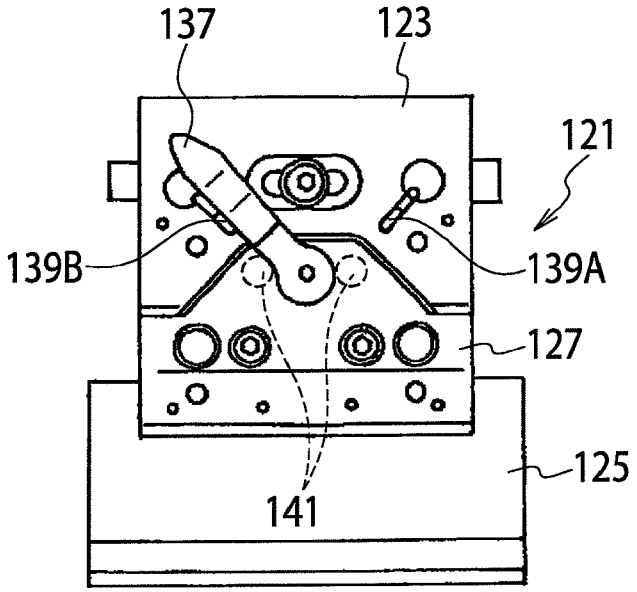
FIG. 9 is a front view of the prior-art upper tool holder (operating lever: unclamp position).
Figure 10:
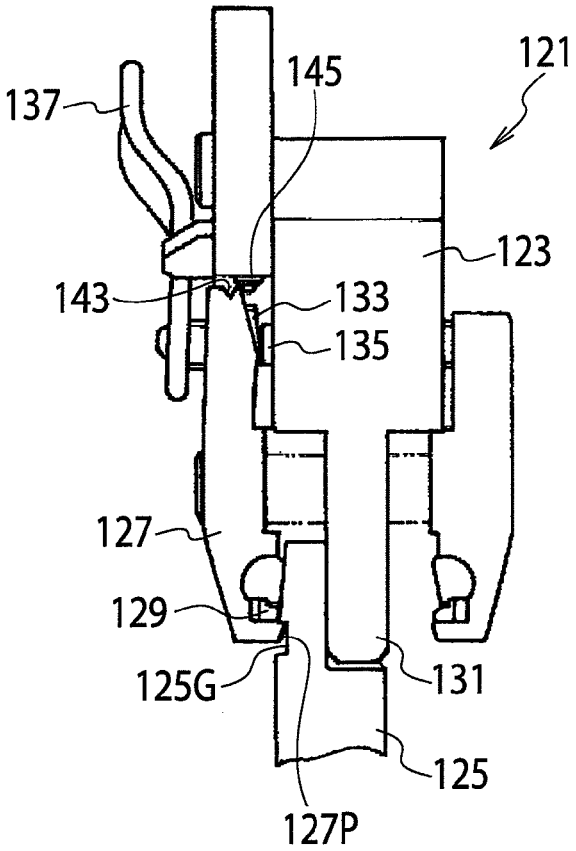
FIG. 10 is a side view of the prior-art upper tool holder shown in FIG. 9.
Figure 11:
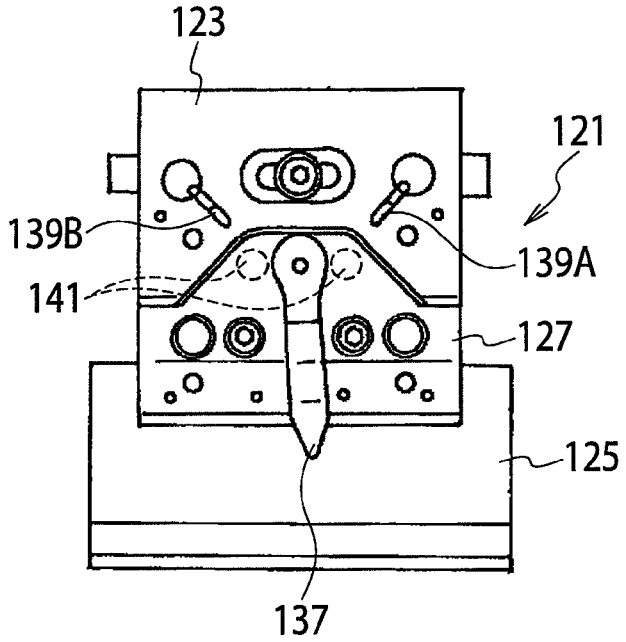
FIG. 11 is a front view of the prior-art upper tool holder (operating lever: vertically-replacing position).
Figure 12:
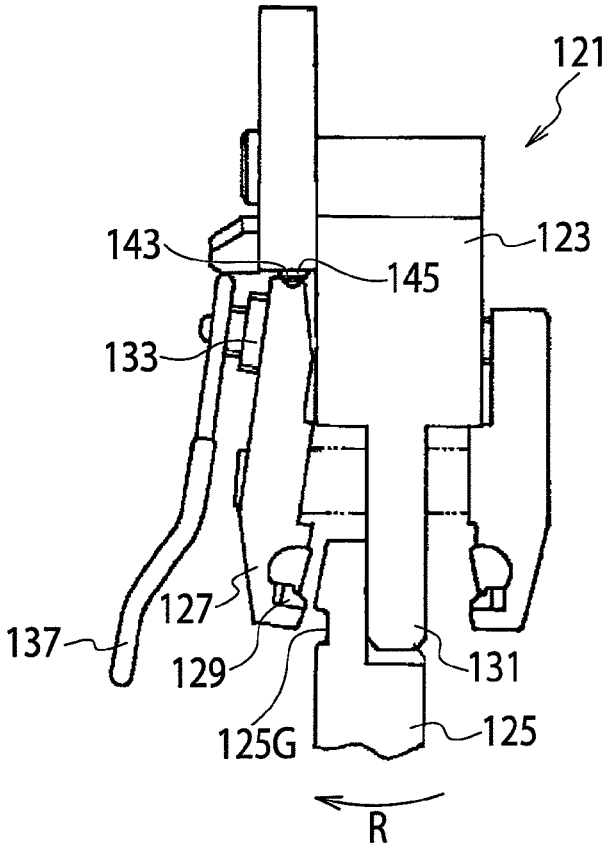
FIG. 12 is a side view of the prior-art upper tool holder shown in FIG. 11.

Therefore, in the present embodiment, provided are an opening operation restriction safety mechanism 41 for preventing the lower portion 17L of the upper tool clamper 17 from unexpectedly opening further in the unclamped state (FIG. and FIG. 4) of the upper tool P. The opening operation restriction safety mechanism 41 is shown in FIG. 6, and a pusher 45 for pushing the upper portion 17U of the upper tool clamper 17 toward a closing direction of the lower portion 17L is provided in a penetrating hole 43 formed in the holder body 5 in the opening operation restriction safety mechanism 41. In the present embodiment, two of the opening operation restriction safety mechanisms 41 are provided symmetrically to the pusher screw 21 (a rotational center of the operating lever 23).

The pusher 45 is constituted of a pin projected forward from the penetrating hole 43 or the like. A flange 45F formed base end of the pusher 45 contacts with a step 47, so that forward projection of the pusher 45 is limited. A coil spring (an elastic member) 51 for urging the pusher forward is disposed between a stopper screw 49 threaded onto the penetrating hole 43 and the pusher 45. Namely, the pusher 45 is urged forward by the coil spring 51 and its forward projection is limited by the contact of the flange 45F and the step 47.

In the unclamped state of the upper tool P, the flange 45F contacts with the step 47, so that the forward projection of the pusher 45 is being limited. Then, in a state where the forward projection of the pusher 45 is being limited, a front end of the pusher 45 slightly contacts with the upper portion 17U of the upper tool clamper 17 (in the clamped state of the upper tool P, the flange 45F contacts with the step 47 but the front end of the pusher 45 doesn't contacts with the upper portion 17U).

Namely, when the upper tool clamper 17 is in the clamped state or the unclamped state (=ordinary state), the pusher 45 stays at its home position where the flange 45F and the step 47 continuously contacts with each other. Subsequently, when the lower portion 17L of the upper tool clamper 17 is opened further from the unclamped state, the pusher 45 pushes the upper portion 17U of the upper tool clamper 17 forward and functions as resistance against the opening operation.

Therefore, unexpected opening of the lower portion 17L of upper tool clamper 17 can be prevented when sliding the upper tool P laterally in the unclamped state, so that drop-off of the upper tool P can be prevented. Then, it is needed to open the upper tool clamper 17 in rivalry with the urging force of the elastic member 51 of the opening operation restriction safety mechanism 41 in order to engage the engagement recess 33 with the ball plunger 35 by opening the lower portion 17L further.

A larger force is needed for replacing the upper tool P vertically after opening the upper tool clamper 17 further, so that it draws attention to open the upper tool clamper 17 further. Therefore, attention is paid to drop-off of the upper tool P, so that safety can be improved. Then, an upper tool P is inserted from beneath to a space between the upper tool clamper 17 and the upper tool holding portion 19 in a state where the lower portion 17L of the upper tool clamper 17 is widely opened and the engagement recess 33 and the ball plunger 35 are engaged with each other, and the urging force of the elastic member 51 functions so as to support the closing operation of the upper tool clamper when closing the lower portion 17L of the upper tool clamper 17.

As explained above, the opening operation restriction safety mechanism 41 functions as resistance against opening operation when opening the lower portion 17L of the upper tool clamper 17 further from the unclamped state, and functions so as to support the closing operation when closing the upper tool clamper 17 from its widely opened state. Therefore, the opening operation restriction safety mechanism 41 constitutes a sort of an auxiliary urging mechanism for supporting the opening operation of the upper tool clamper 17.

In addition, the upper tool clamper 17 can be set to the clamped state, the unclamped state or the vertically-replacing state by the rotational operation of the operating lever 23. Then, in the unclamped state, unexpected opening of the upper tool clamper 17 can be prevented by the opening operation restriction safety mechanism (auxiliary urging mechanism) 41 while allowing the lateral slide of the upper tool P, so that drop-off of the upper tool P can be prevented. Namely, safety can be improved.

The invention claimed is:

1. An upper tool holder for a press brake for holding an upper tool of the press brake, comprising:

a holder body;

an upper tool clamper that is provided on the holder body, and capable of swinging in an open-close direction when replacing the upper tool;

wherein the upper tool clamper is capable of being in a clamped state where the upper tool clamper is fully closed and fixedly holds the upper tool, an unclamped state where the upper tool clamper is opened from the clamped state and holds the upper tool slidably, and a vertically-replacing state where the upper tool clamper is further opened from the unclamped state and the upper tool can be replaced vertically, and an ordinary state is a state where the upper tool clamper is in the clamped state or the unclamped state, a drop prevention piece that is provided at a lower portion of the upper tool clamper, and capable of engaging with a drop prevention groove formed on the upper tool;

an engagement recess that is provided on one of an upper portion of the upper tool clamper and the holder body;

an engagement protrusion that is provided on the other of the upper portion of the upper tool clamper and the holder body, and capable of engaging with the engagement recess;

an auxiliary urging mechanism that functions as resistance when further opening the upper tool clamper to the vertically-replacing state in order to replace the upper tool, and when closing the upper tool clamper from the vertically-replacing state; and a pusher that is provided in the auxiliary urging mechanism, and stays at a home position in the ordinary state regardless of opening or closing of the upper tool clamper, and wherein the auxiliary urging mechanism includes the pusher and an elastic member that urges the pusher toward the upper tool clamper.

2. The upper tool holder according to claim 1, wherein the pusher stays at the home position under a condition where urged by the elastic member in the state where the upper tool clamper is in the clamped state or the unclamped state, and moves from the home position and urges the upper tool clamper in the closing direction by an elastic restoring force of the elastic member in a state where the upper tool clamper is in the vertically-replacing state.

3. The upper tool holder according to claim 2, wherein the engagement recess and the engagement protrusion are engaged with each other in the state where the upper tool clamper is in the vertically-replacing state, so that the upper tool clamper is held in the vertically-replacing state.

* * * * *